US005282737A

United States Patent [19]

Ray

[11] Patent Number: 5,282,737

[45] Date of Patent: Feb. 1, 1994

[54] CANDLE SNUFFING APPARATUS AND METHOD

[76] Inventor: R. Charles Ray, 1515 S. "K" St., Tacoma, Wash. 98405

[21] Appl. No.: 894,056

[22] Filed: Jun. 3, 1992

[51] Int. Cl.[5] ..... F23Q 25/00

[52] U.S. Cl. ..... 431/2; 431/144; 294/99.2; 294/118; 169/46; 131/236; 81/418

[58] Field of Search ..... 431/2, 33, 34, 35, 88, 431/144, 145; 169/46; 81/418, 424.5, 426.5; 131/236; 294/99.1, 99.2, 118; 126/25 C; 100/234; 407/129, 130, 118, 191; D7/666; D27/102, 136; D29/2

[56] References Cited

U.S. PATENT DOCUMENTS

| | | | |
|---|---|---|---|
| Re. 4,841 | 4/1872 | Stow et al. . | |
| 48,354 | 6/1865 | Asmus | 294/99.2 X |
| D. 254,466 | 3/1980 | Carson | 100/234 X |
| 467,367 | 11/1892 | Calef | 294/118 X |
| 633,779 | 9/1899 | Bagley | 15/220.3 X |
| 849,789 | 4/1907 | Hurd | 294/99.2 |
| 940,832 | 11/1909 | Swoger . | |
| 1,948,880 | 2/1934 | Hamm | 131/256 |
| 2,483,985 | 10/1949 | Sonn | 100/234 |
| 2,638,905 | 5/1953 | Morrison | 131/236 |
| 2,887,948 | 5/1959 | Kramer et al. | 100/234 X |
| 3,426,762 | 2/1969 | Vitale | 131/236 |
| 3,775,037 | 11/1973 | Sande | 431/144 |
| 4,126,962 | 11/1978 | Polcaro | 294/99.2 X |
| 4,199,180 | 4/1980 | Kelly | 294/99.2 X |
| 4,497,374 | 2/1985 | Millar | 169/46 |
| 4,602,611 | 7/1986 | Hankey et al. | 126/390 |
| 4,904,009 | 2/1990 | Kozlinski | 100/234 X |

FOREIGN PATENT DOCUMENTS

| | | | |
|---|---|---|---|
| 3743630 | 3/1989 | Fed. Rep. of Germany | 294/99.2 |
| 23610 | of 1913 | United Kingdom | 431/35 |

OTHER PUBLICATIONS

Popular Science, Apr. 1948, U.S.C.L., p. 229.

*Primary Examiner*—Carl D. Price

*Attorney, Agent, or Firm*—Christensen, O'Connor, Johnson & Kindness

[57] ABSTRACT

A candle snuffing apparatus and method are disclosed in the form of tongs having wettable snuffing surfaces and means for wetting the snuffing surfaces. Operation of the tongs upon a candle flame extinguishes the flame and simultaneously cools the wick, preventing smoking of the wick.

6 Claims, 2 Drawing Sheets

Fig. 4.
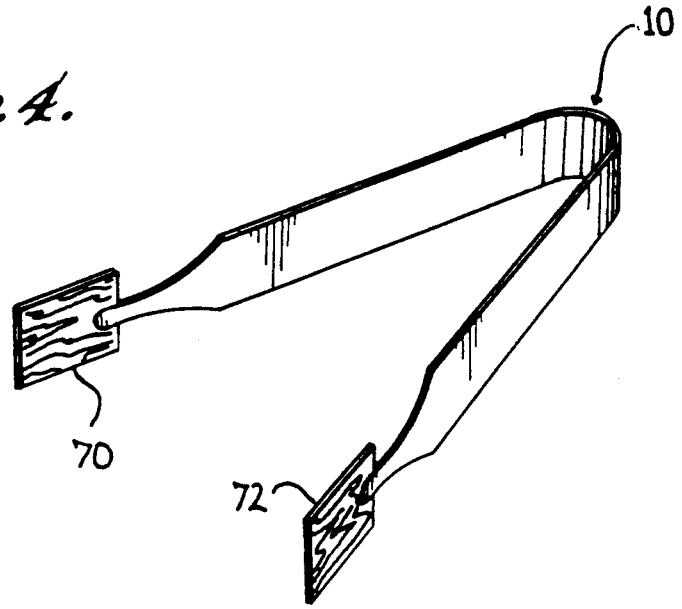
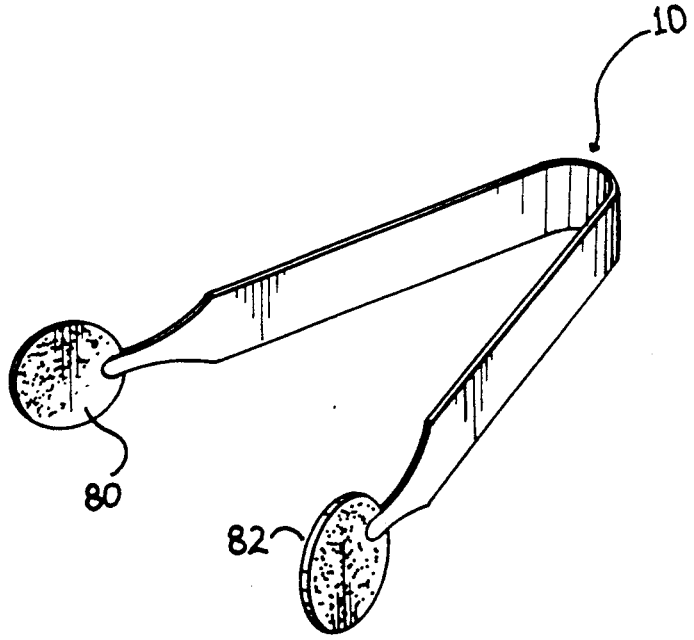
Fig 5.

CANDLE SNUFFING APPARATUS AND METHOD

FIELD OF THE INVENTION

The present invention is generally directed toward an apparatus and method for snuffing candles, and more particularly, to a novel apparatus and method for extinguishing the flame of a burning candle wick and simultaneously cooling the hot wick, thus preventing the extinguished candle from smoking.

BACKGROUND OF THE INVENTION

Prior candle snuffers utilize some means for smothering a candle flame, either by capping or covering the end of the wick, or by pinching the wick itself. In each of these cases, oxygen is excluded from the wick for a sufficient period of time or sufficient heat is withdrawn from the flame to extinguish the flame. In these cases, however, distillation continues to occur at the wick until the wick has cooled, resulting in smoking of the candle wick after the flame is extinguished, and the attendant burning smell.

It is an object of the present invention to provide an apparatus and method for extinguishing the flame while simultaneously cooling the wick. Immediately cooling the wick will terminate combustion at the wick, with the advantage of ending the smoking of the candle wick, and thus eliminating the undesirable after smell at the time the flame is extinguished.

SUMMARY OF THE INVENTION

The invention contemplates a set of tongs having snuffing surfaces which are operated so as to pinch or surround a candle flame. The snuffing surfaces are made of a material which is wettable, that is, capable of retaining some water or other liquid on their surfaces for a suitable period of time. Operation of the tongs brings the wetted snuffing surfaces into opposing contact about the candle wick, excluding the oxygen and extinguishing the flame. Simultaneously, contact of the wick with the wetted snuffing surfaces causes rapid cooling of the wick, terminating distillation at the wick, and eliminating the smoke and smell.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 4 is a perspective view of an alternate embodiment of a candle snuffer having snuffing surfaces made of wood; and FIG. 5 is a perspective view of an alternate embodiment of a candle snuffer having snuffing surfaces made of porous ceramic.

DETAILED DESCRIPTION OF THE PREFERRED EMBODIMENT

Figure 1:
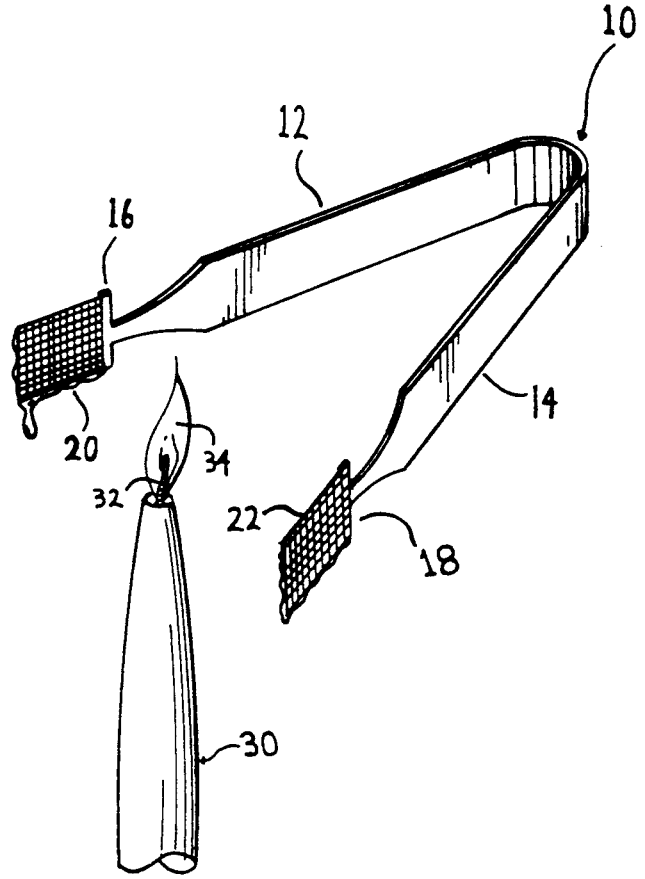
FIG. 1 is a perspective view of a candle snuffer embodying the invention, and showing wire mesh snuffing surfaces.

Referring to FIG. 1, in this embodiment, the candle snuffer 10 is formed as a single, unitary implement having tongs, the handles 12 and 14 of which terminate in distal ends 16 and 18. Affixed to the handle distal ends 16 and 18, by suitable mechanical or adhesive means, are snuffing surfaces 20 and 22. The snuffing surfaces are formed of a wettable material, that is, one capable of retaining water or other liquid for a short period of time after immersion. The material depicted in FIG. 1 is wire mesh, presently believed to be the best embodiment because of its low cost and ease of use in cutting and shaping. Rectangular shapes are shown, but shapes such as disks would also be suitable. Other wettable materials could be used in place of wire mesh, such as porous ceramic or relatively porous or absorptive woods.

In use, the snuffing surfaces are first wetted with water or other liquid. The candle snuffer is then positioned as shown in FIG. 1 about the wick of the candle to be extinguished, and the snuffing surfaces are brought into mutually opposing relationship with each other, the wick positioned therebetween. As the snuffing surfaces contact the wick, the flame is extinguished and the wick is cooled simultaneously.

Figure 2:
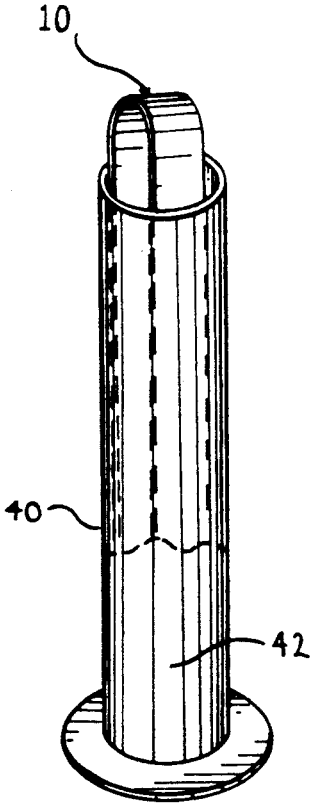
FIG. 2 is a perspective view of the candle snuffer in its stored condition in a water-containing vessel.

Referring to FIG. 2 the preferred means for wetting the snuffing surfaces is a water-containing vessel 40 into which the tongs 10 can be immersed. Preferably, the candle snuffer tongs 10 are disposed, when not in use, within the vessel 40 containing water in its interior 42. This provides storage of the candle snuffer as well as a ready source of liquid for wetting the snuffing surfaces.

Figure 3:
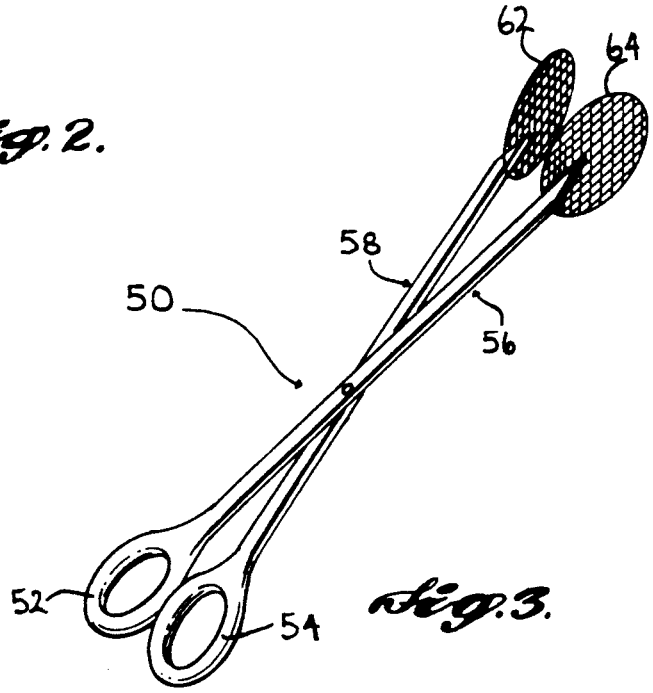
FIG. 3 is a perspective view of an alternate embodiment of a candle snuffer embodying the present invention, showing the use of "scissor-type" tongs.

An alternative embodiment of the invention is depicted in FIG. 3. Here the candle snuffer 50 is made in the form of scissor-type tongs, having finger loops 52 and 54 at their proximal ends, operation of which move distal ends 56 and 58 about a pivot point 60. The pivot point consists of a screw, rivet or other suitable joining means which permit rotation about the pivot point. The snuffing surfaces 62 and 64 are affixed to the handle distal ends 56 and 58 by mechanical or adhesive means, and are formed of a wettable material, as described above.

A further alternative embodiment is shown in FIG. 4, wherein the candle snuffer 10 has wood snuffing surfaces 70 and 72. Another alternative embodiment is shown in FIG. 5, wherein the candle snuffer 10 has porous ceramic snuffing surfaces 80 and 82.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for extinguishing a candle flame, comprising the steps of:

(a) wetting substantially flat wettable snuffing surfaces affixed to the distal ends of tongs; and (b) bringing the wetted snuffing surfaces into mutually opposing relationship with each other on either side of a candle wick and into contact with the wick.

2. A device for extinguishing a candle flame, comprising:

a first, wettable snuffing surface comprising wire mesh;

a second, wettable snuffing surface comprising wire mesh;

means for bringing said first wettable wire mesh snuffing surface and said second wettable wire mesh snuffing surface into mutually opposing relationship with each other on either side of a candle wick; and means for wetting each of said wettable wire mesh snuffing surfaces before bringing them into mutually opposing relationship with each other on either side of a candle wick.

3. A device for extinguishing a candle flame, comprising:

a first, wettable wire mesh snuffing surface;

a second, wettable wire mesh snuffing surface;

means for bringing said first wettable wire mesh snuffing surface into mutually opposing relationship with said second wettable wire mesh snuffing surface; and wetting means, comprising a storage vessel capable of containing liquid, said storage vessel being of sufficient dimension to receive said wettable wire mesh snuffing surfaces, for wetting each of said wettable wire mesh snuffing surfaces before bringing them into mutually opposing relationship with each other on either side of a candle wick.

4. A device for extinguishing a candle flame, comprising:

tongs having substantially flat wettable wire mesh snuffing surfaces at their distal ends, the distal ends of which are capable of being brought into mutually opposing relationship or separated by operation of the proximal ends; and means for wetting each of said wettable wire mesh snuffing surfaces before bringing them into mutually opposing relationship with each other on either side of a candle wick.

5. A device for extinguishing a candle flame, comprising:

tongs having substantially flat porous ceramic snuffing surfaces at their distal ends, the distal ends of which are capable of being brought into mutually opposing relationship or separated by operation of the proximal ends; and means for wetting each of said wettable porous ceramic surfaces before bringing them into mutually opposing relationship with each other on either side of a candle wick.

6. A device for extinguishing a candle flame, comprising:

tongs having substantially flat wood snuffing surfaces at their distal ends, the distal ends of which are capable of being brought into mutually opposing relationship or separated by operation of the proximal ends; and means for wetting each of said wettable wood snuffing surface before bringing them into mutually opposing relationship with each other on either side of a candle wick.

* * * * *